US006065458A

United States Patent [19]

Ozeki

[11] Patent Number: 6,065,458

[45] Date of Patent: May 23, 2000

[54] BLOWBY GAS PATH STRUCTURE OF INTERNAL COMBUSTION ENGINE

[75] Inventor: Hisashi Ozeki, Hamamatsu, Japan

[73] Assignee: Suzuki Motor Corporation, Shizuoka-ken, Japan

[21] Appl. No.: 09/316,890

[22] Filed: May 21, 1999

[30] Foreign Application Priority Data

May 30, 1998 [JP] Japan ..... 10-166067

[51] Int. Cl.[7] ..... F01M 13/00

[52] U.S. Cl. ..... 123/572

[58] Field of Search ..... 123/572, 573, 123/574, 41–86

[56] References Cited

U.S. PATENT DOCUMENTS 4,345,573 8/1982 Obata ..... 123/572
4,585,946 8/1987 Umeda et al. ..... 123/572
5,069,192 12/1991 Matsumoto et al. ..... 123/572
5,664,549 9/1997 Hutchins ..... 123/572
5,690,084 11/1997 Gunji et al. ..... 123/572
5,937,836 8/1999 Yonezawa et al. ..... 123/572

*Primary Examiner*—Marguerite Mc Mahon
*Attorney, Agent, or Firm*—Flynn, Thiel, Boutell & Tanis, P.C.

[57] ABSTRACT

A blowby gas path structure for an internal combustion engine prevents deterioration in an oil separating function of a breather chamber of a head cover by reducing oil mist conveyed therethrough. The blowby gas path structure includes a plurality of blowby gas paths. The plurality of blowby gas paths have different path sectional areas. Ends of the gas paths are opened to a crank chamber of an internal combustion engine and pass through a cylinder block and a cylinder head. The other ends of the gas paths are opened to a breather chamber of a head cover and open at a communication chamber.

13 Claims, 9 Drawing Sheets

BLOWBY GAS PATH STRUCTURE OF INTERNAL COMBUSTION ENGINE

FIELD OF THE INVENTION

The present invention relates to a blowby gas path structure of an internal combustion engine, particularly to a blowby gas path structure of an internal combustion engine capable of reducing oil mist conveyed by a blowby gas path having a large flow rate in a plurality of blowby gas paths. The invention improves an oil separating function of a breather chamber of a head cover.

BACKGROUND OF THE INVENTION

In an internal combustion engine, there are installed blowby gas paths for guiding blowby gas, passing from a combustion chamber via an intermediary between a piston and a cylinder sleeve and leaking to a crank chamber, returning gas again to the combustion chamber and combusting the blowby gas. The blowby gas path is installed to open at one end to a crank chamber, to pass through a cylinder block and a cylinder head and to open at its other end to a breather chamber of a head cover.

Blowby gas guided by the blowby gas paths to the breather chamber, is separated of oil mist included in the gas, sucked to an intake system via a PCV valve operated by intake negative pressure and is combusted by being supplied to the combustion chamber along with intake air.

Such blowby gas path structures of an internal combustion engine have been disclosed in JP-B-5-3692U, JP-A-63-79417U, JP-A-64-49617U, JP-A-62-64805U, JP-A-58-62113U, JP-A-2-52912U, JP-A-2-94312U and JP-A-3-54224U.

According to the disclosure of JP-B-5-3692U, there is installed a breather path passing from a crank chamber of an engine and having a substantially horizontal axial line to a cylinder and to an upper face side of a cylinder block to communicate with a cam chamber of a cylinder head.

According to the disclosure of JP-A-63-79417U, in an engine in which a cylinder head and a cylinder block are fixed by through bolts penetrating the cylinder block, there are installed communication holes for communicating the crank chamber and the cam chamber via the through bolts.

According to the disclosure of JP-A-64-49617U, an engine installed with a projected portion projecting outside at a side wall of a cylinder head supports a balancer shaft. There is a volume chamber above the projected portion of the cylinder block and there is a blowby gas path for communicating a crank chamber with a valve operating chamber via the volume chamber.

According to the disclosure of JP-A-62-64805U, there are installed oil dropping paths and blowby gas paths extending upward from a crank case at a side face of a cylinder block installed with oil dropping paths and blowby gas paths. The oil dropping paths and the blowby gas paths of the cylinder block communicate at positions of a cylinder head outside of attaching bolts.

According to the disclosure of JP-A-58-62113U, a midway of a blowby gas path in a cylinder block and a cylinder head is formed substantially in a crank shape.

According to the disclosure of JP-A-2-52912U, a breather chamber is connected to a lower side of a breather path communicating with a crank case and a cylinder head and there is installed a bypass path for communicating the breather chamber and an upper side of the breather path.

According to the disclosure of JP-A-2-94312U, a breather apparatus includes a breather chamber lid which is attached to an opening portion of a breather chamber at a side face of a crank case and a breather pipe for connecting the breather chamber and an air cleaner which is attached to the breather chamber lid. In an attitude of rolling an engine where the breather chamber is disposed on the lower side, an opening portion of the breather chamber lid opens to the breather chamber, and projects in a pipe-like shape on an upper side of a blowby gas guide out port of the breather chamber.

According to the disclosure of JP-A-3-54224U, there is installed a ventilation path constituting a portion of a blowby gas recirculating path that introduces new air into a blowby gas exhaust path. The ventilation path is arranged to pass through a head cover, a cylinder head and a cylinder block successively from the upstream side. A downstream side end portion thereof is opened to a crank case. In the meantime, a path sectional area of the ventilation path at an intermediary from a position at a vicinity of a matching face of the cylinder head and the cylinder block to an opening portion of the crank case, is set to be larger than a path sectional area of the ventilation path in the cylinder block on a side upstream therefrom and larger than a sectional area of the ventilation path in the cylinder head.

In the meantime, there is an internal combustion engine having a plurality of cylinders aligned in series. According to the blowby gas path structure of such an internal combustion engine, there is one in which a plurality of blowby gas paths are installed and disposed on one side of the internal combustion engine in a width direction among cylinders, and aligned independently from each other.

However, when path sectional areas of the plurality of blowby gas paths differ from each other, a blowby gas flow rate of a blowby gas path having a larger path sectional area becomes larger than that of a blowby gas path having a smaller path sectional area and causes a drawback in that much oil mist is conveyed into a breather chamber by the blowby gas path having the larger path sectional area and the oil separating function is deteriorated.

SUMMARY OF THE INVENTION

According to the invention, there is provided a blowby gas path structure of an internal combustion engine featuring a plurality of blowby gas paths having different path sectional areas. One end of the blowby gas paths pass through a cylinder block and a cylinder head and open to a crank chamber of the internal combustion engine. The other ends of the blowby gas paths open to a breather chamber of a head cover installed with a communication chamber for communicating the plurality of blowby gas paths.

The plurality of blowby gas paths are disposed on one side in a width direction among cylinders of an internal combustion engine having a plurality of cylinders aligned in series and installed to be aligned in a longitudinal direction independently from each other. Path sectional areas of the blowby gas paths respectively disposed in the longitudinal direction on an intermediary side portion of the cylinder block are larger than path sectional areas of the respective blowby gas paths respectively disposed in the longitudinal direction on end side portions of the cylinder block.

The plurality of blowby gas paths can comprise block side blowby gas paths of the cylinder block and head side blowby gas paths of the cylinder head communicating with the block side blowby gas paths. One end of the respective block side blowby gas paths are disposed in a longitudinal direction on end side portions of the cylinder block and open to an upper side of a crank chamber. Other ends thereof open to a head match face.

The one ends of the block side blowby gas paths disposed in the longitudinal direction on an intermediate or intermediary side portion of the cylinder block are installed to branch and to respectively open to an upper side of the crank chamber and the other ends thereof are installed to gather together and to open to the head match face.

The cylinder block can include a communication chamber for communicating the respective block side blowby gas paths. The cylinder block can include a communication path for communicating the respective block side blowby gas paths respectively disposed on the end portion sides of the cylinder block in the longitudinal direction and a chain chamber of a chain cover.

The cylinder head can be installed with a communication chamber respectively communicating the respective head side blowby gas paths. The head match face of the cylinder block and a block match face of the cylinder head can include a communication chamber for respectively communicating among the respective block side blowby gas paths and the respective head side blowby gas paths aligned independently from each other. The cylinder block can have the block side blowby gas path disposed on the intermediary side portion in the longitudinal direction separate into two block side separated blowby gas paths arranged proximate to each other. The one end of each of the two block side separated blowby gas paths can open to the upper side of the crank chamber and the other ends can respectively open to the head match face to communicate with the head side blowby gas paths.

Thereby, according to the blowby gas path structure, oil mist can be made difficult to convey by reducing a flow speed of the blowby gas path having a large path sectional area on the intermediary side portion and thus a large flow rate in comparison with the respective blowby gas paths on the end side portions. A communication chamber communicates the plurality of blowby gas paths to reduce the flow rate of the largest blowby gas path. Ventilation can be carried out from operating negative pressure of intake air to the communication paths.

DETAILED DESCRIPTION

Figure 13:
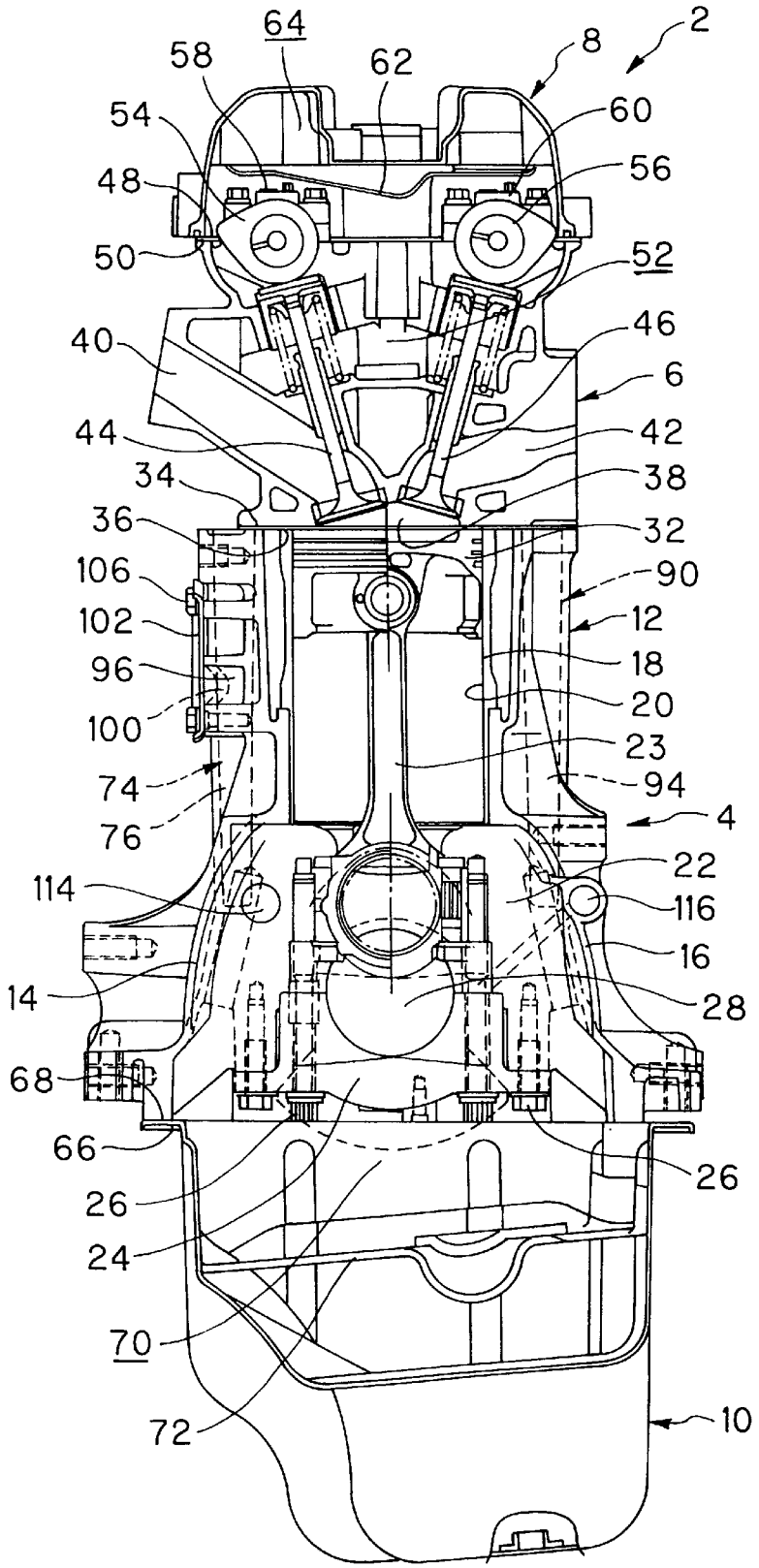
FIG. 13 is a sectional view of a center of a cylinder of an internal combustion engine.
Figure 14:
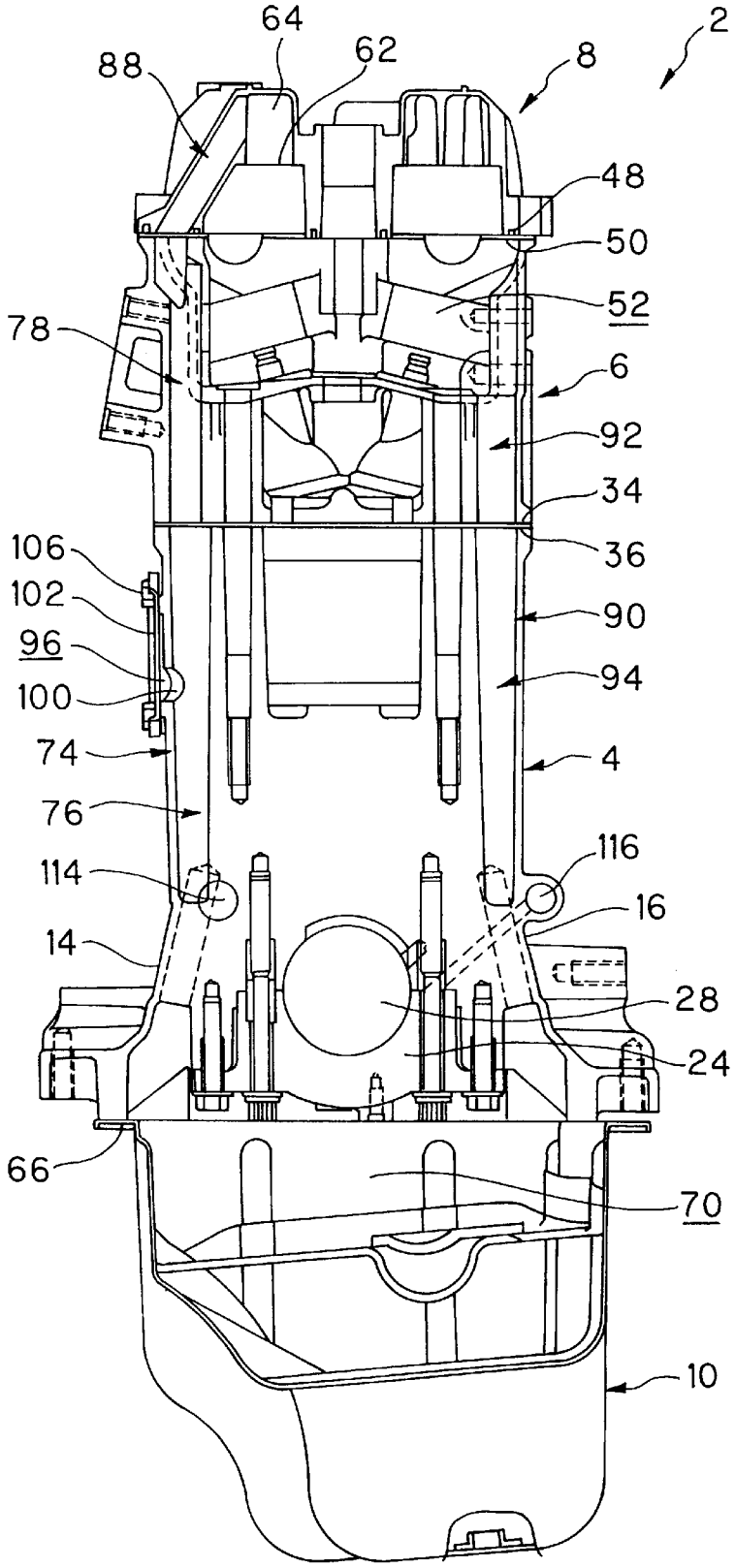
FIG. 14 is a sectional view illustrating an oil dropping path extending through the cylinder block and cylinder head of the internal combustion engine.

An explanation will be given of embodiments of the invention in reference to FIG. 1–14 showing a first embodiment of the invention. In FIG. 13 and FIG. 14, numeral 2 designates an internal combustion engine, numeral 4 designates a cylinder block, numeral 6 designates a cylinder head, numeral 8 designates a head cover and numeral 10 designates an oil pan. The internal combustion engine 2 is installed with a cylinder portion 12 on the upper side of the cylinder block 4 and with side skirt portions 14, 16 respectively. The side skirt portions 14, 16 are hung from respective sides of the cylinder block in the width direction on the lower side of the cylinder portion 12.

As shown in FIG. 13, the cylinder block 4 is installed by press-fitting a cylinder sleeve 18 to the cylinder portion 12 to form a cylinder 20. A crank shaft support portion 22 is installed in the width direction between the respective side skirt portions 14, 16 and axially supports a crank shaft 28 by attaching a crank shaft cap 24 to the crank shaft support portion 22 with cap attaching bolts 26. The crank shaft 28 is connected to a piston 32 by a connecting rod 23.

The cylinder block 4 is installed by bringing a block match face 36 of the cylinder head 6 into contact with a head match face 34 on the upper side of the cylinder portion 12 using head attaching bolts (not illustrated). The cylinder head 6 includes an intake port 40 and an exhaust port 42 communicating with a combustion chamber 38. The cylinder head 6 also includes an intake valve 44 and an exhaust valve 46 for opening and closing the intake port 40 and the exhaust port 42.

The cylinder head 6 is installed with a valve operating chamber 52 by bringing a head match face 50 of the head cover 8 into contact with a cover match face 48 on the upper side and by attaching the head match face 50 to the cover match face 48 using cover attaching bolts (not illustrated). In the valve operating chamber 52, an intake cam shaft 54 and an exhaust cam shaft 56 drive open and close the intake valve 44 and the exhaust valve 46. The cam shafts 54, 56 are axially supported by the cylinder head 6 along with an intake cam shaft cap 58 and an exhaust cam shaft cap 60. The head cover 8 is installed with a breather chamber 64 partitioned from the valve operating chamber 52 by a breather plate 62.

The cylinder block 4 is installed by bringing a block match face 68 of the oil pan 10 into contact with an oil pan match face 66 on the lower side of the respective side skirt portions 14 and 16 and by attaching the block match face 68 to the oil pan match face 66 using oil pan attaching bolts (not illustrated). A crank chamber 70 is located between the respective side skirt portions 14, 16 and the oil pan 10. A buffer plate 72 is installed in the oil pan 10.

As shown by FIG. 7 through FIG. 12, the internal combustion engine 2 is provided with a plurality of cylinders 20 aligned in series. According to the embodiment, there are provided four cylinders 20-1 through 20-4. The cylinder block 4 is installed with the respective crank shaft support portions 22 to connect the respective side skirt portions 14, 16 on an outer side of the first cylinder portion 12 and an outer side of the fourth cylinder portion 20-4.

The internal combustion engine 2 is installed with a plurality of blowby gas paths 74 having different path sectional areas. One end side or one end of the paths are opened to the crank chamber 70 and pass through the cylinder block 4 and the cylinder head 6. The other end side or ends of the paths are opened to the breather chamber 64 of the head cover 8. According to the embodiment, there are installed a first through a third blowby gas path 74-1 to 74-3.

As shown in FIGS. 1–6, the plurality of blowby gas paths 74-1 through 74-3 are disposed on one side in the width direction (intake side installed with the intake ports 40). The plurality of cylinders 20-1 through 20-4 are aligned in series and installed to align independently from each other in the longitudinal direction.

Figure 7:
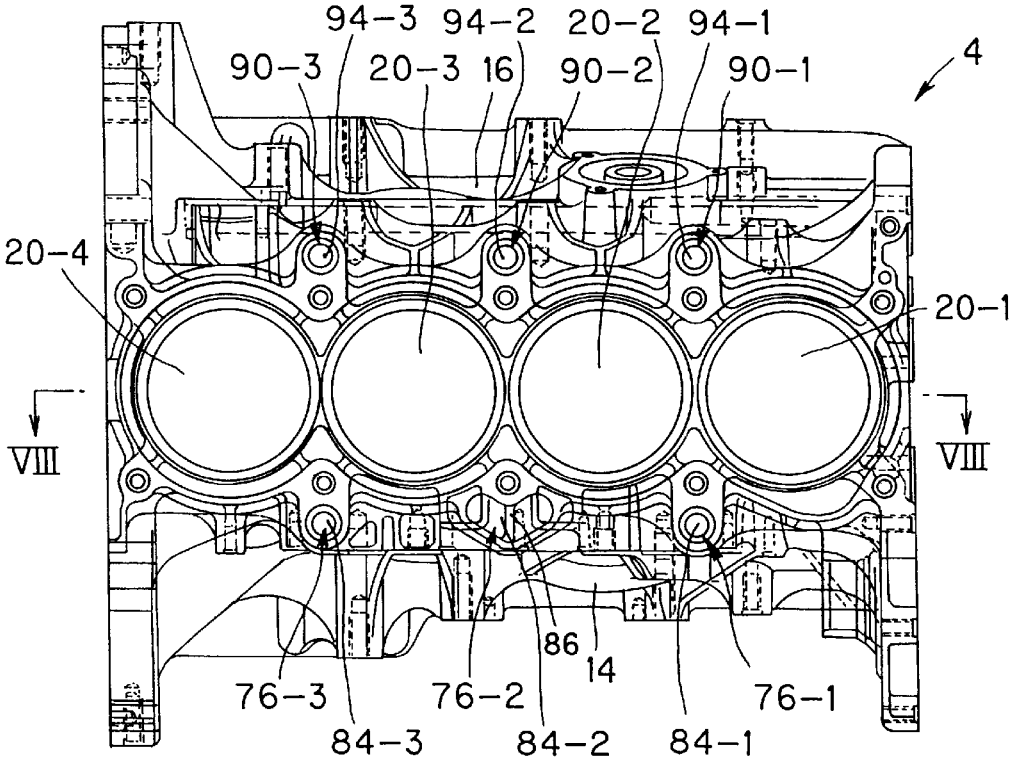
FIG. 7 is a plane view of the cylinder block.
Figure 8:
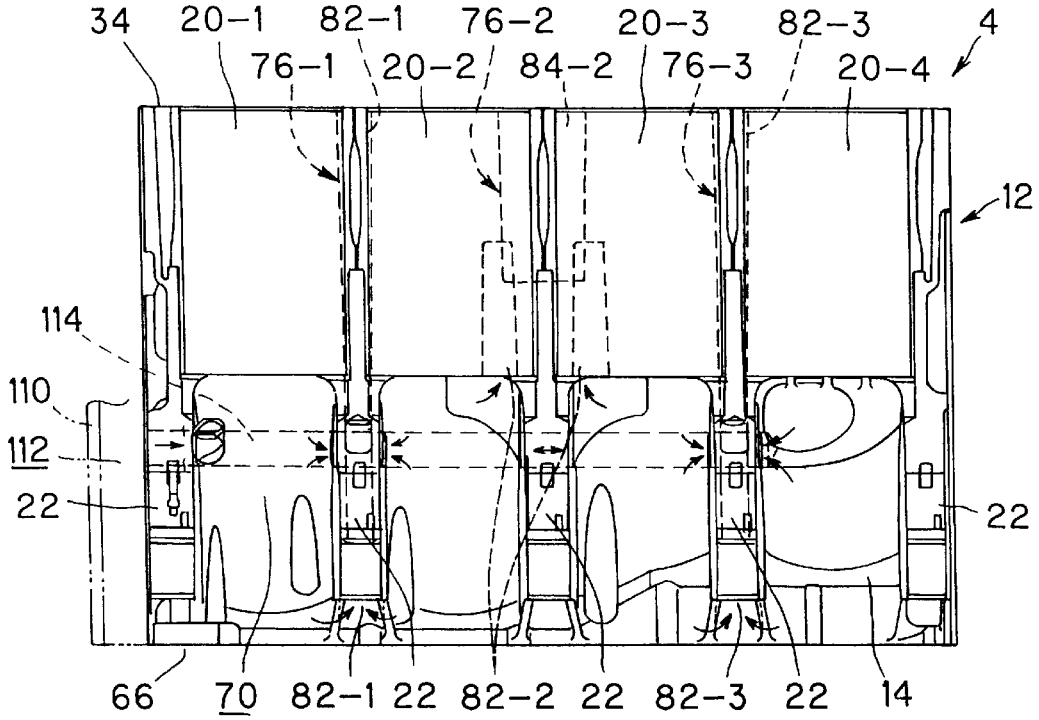
FIG. 8 is a sectional view taken along a line VIII—VIII of FIG. 7.
Figure 9:
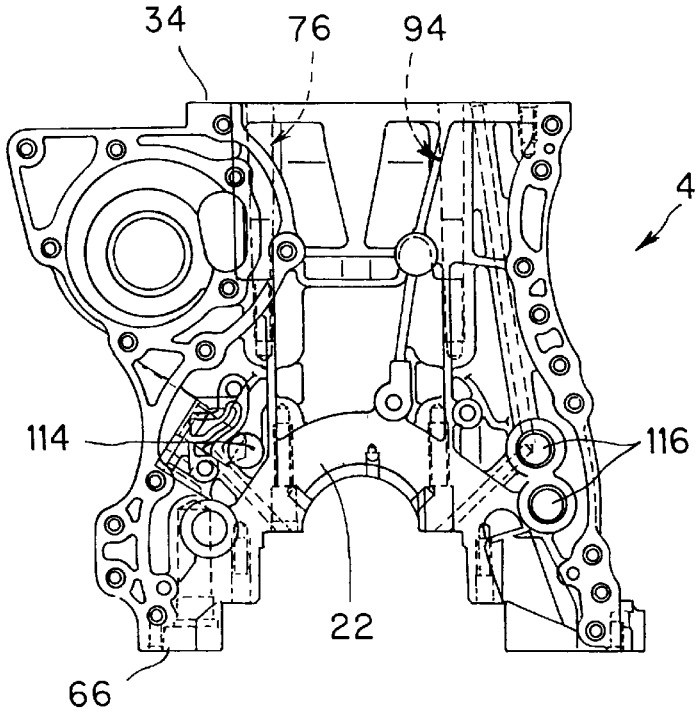
FIG. 9 is a side view of the cylinder block in view from an arrow mark IX of FIG. 1.
Figure 10:
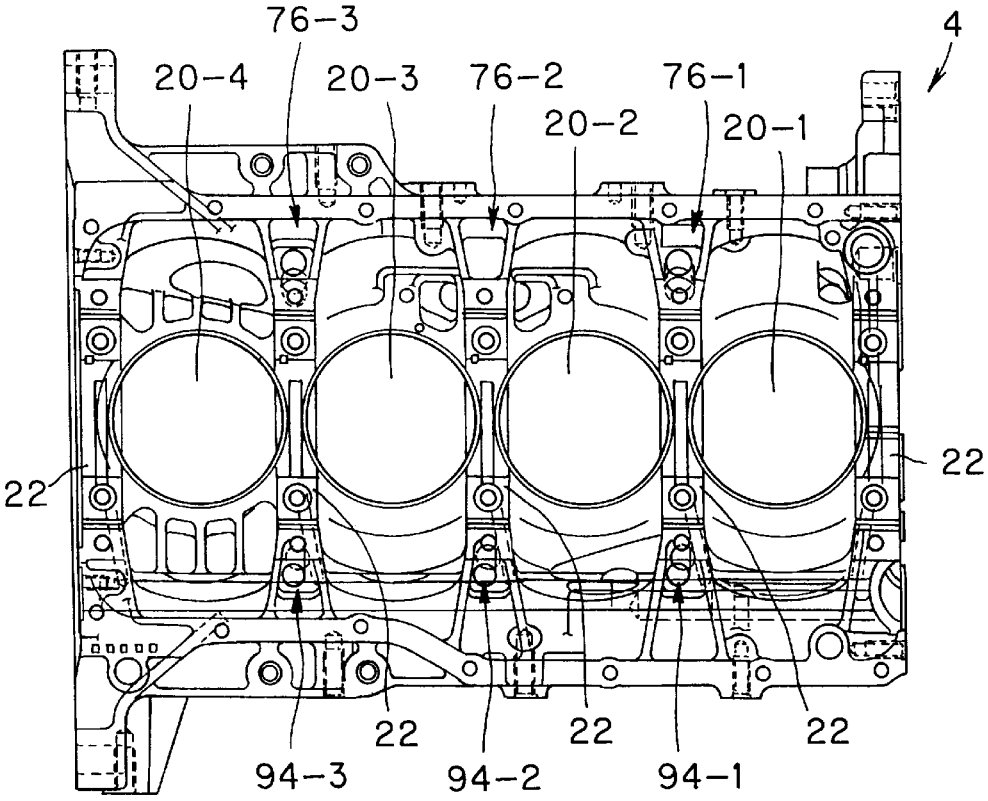
FIG. 10 is a bottom view of the cylinder block.

The blowby gas paths 74-1 through 74-3 are installed such that a path sectional area of the second blowby gas path 74-2 disposed on an intermediary side portion in the longitudinal direction is formed to be larger than path sectional areas of the first and the third blowby gas paths 74-1 and 74-3 disposed on end side or corner side portions in the longitudinal direction of the cylinder block 4. As shown in FIG. 7, the intermediary side portion is positioned between the end side portions which include block side blowby gas paths 76-1 and 76-3. The end side portions and intermediary side portion are defined on one side or side portion of the engine as shown in FIG. 7. Oil dropping paths 90-1 through 90-3 are defined on the other side portion of the engine.

The plurality of blowby gas paths 74-1 through 74-3 are constituted by block side blowby gas paths 76-1 through 76-3 of the cylinder block 4 and head side blowby gas paths 78-1 through 78-3 of the cylinder head 6 communicating with the block side blowby gas paths 76-1 through 76-3.

The block side blowby gas paths 76 are constituted by the first and the third blowby gas paths 76-1 and 76-3 disposed in the longitudinal direction on the end side portions of the cylinder block 4. The block side second blowby gas path 76-2 having the large path sectional area is disposed in the longitudinal direction on the intermediary side portion of the cylinder block between or intermediate the end side portions. Further, the head side blowby gas paths 78 are constituted by the head side first and third blowby gas paths 78-1 and 78-3 disposed on the end side portions on the top side of the cylinder head 6 in the longitudinal direction. The head side second blowby gas path 78-2 having the large path sectional area is disposed in the longitudinal direction on the intermediary side portion of the cylinder head 6, between the first and third blowby gas paths.

As shown by FIG. 1 through FIG. 4, the block side first blowby gas path 76-1 projects from one side wall portion 80 on one side in the width direction of the cylinder portion 12 between the first and the second cylinders 20-1 and 20-2 and penetrates the crank shaft support portion 22 between the first and the second cylinders 20-1 and 20-2. The block side second blowby gas path 76-2 projects from the one side wall portion 80 of the cylinder portion 12 between the second and the third cylinders 20-2, 20-3 and penetrates the crank shaft support portion 22 between the cylinders 20-2 and 20-3. The block side third blowby gas path 76-3 projects from the one side wall portion 80 of the cylinder portion 12 between the third and the fourth cylinders 20-3 and 20-4 and penetrates the crank shaft support portion 22 between the cylinders 20-3 and 20-4.

Figure 1:
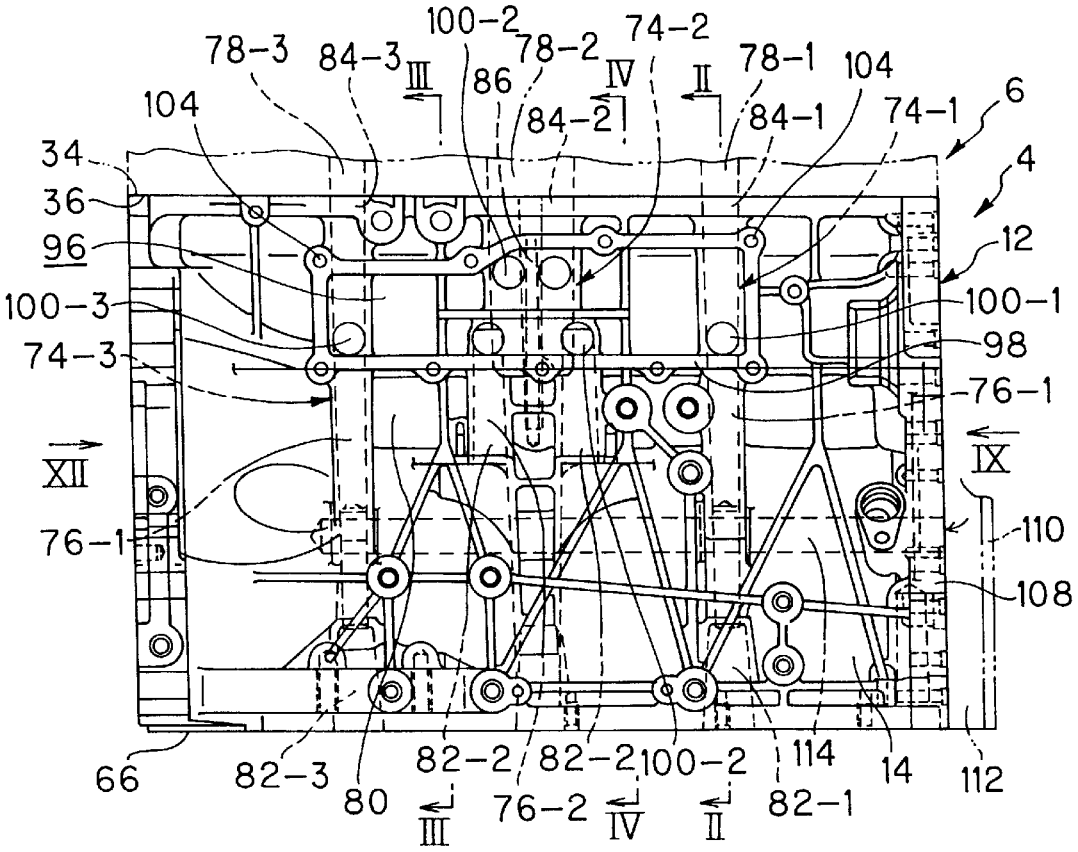
FIG. 1 is a side view of a cylinder block installed with a blowby gas path structure showing an embodiment of the invention.
Figure 2:
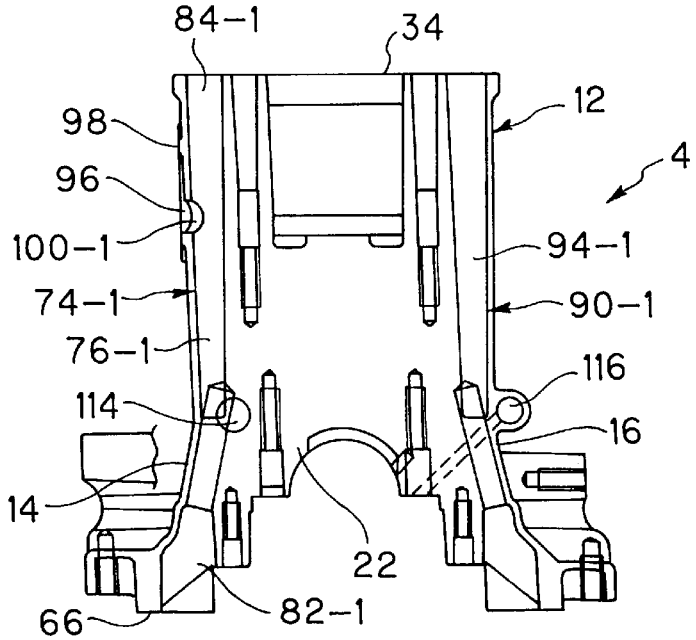
FIG. 2 is a sectional view taken along a line II—II of FIG. 1.
Figure 3:
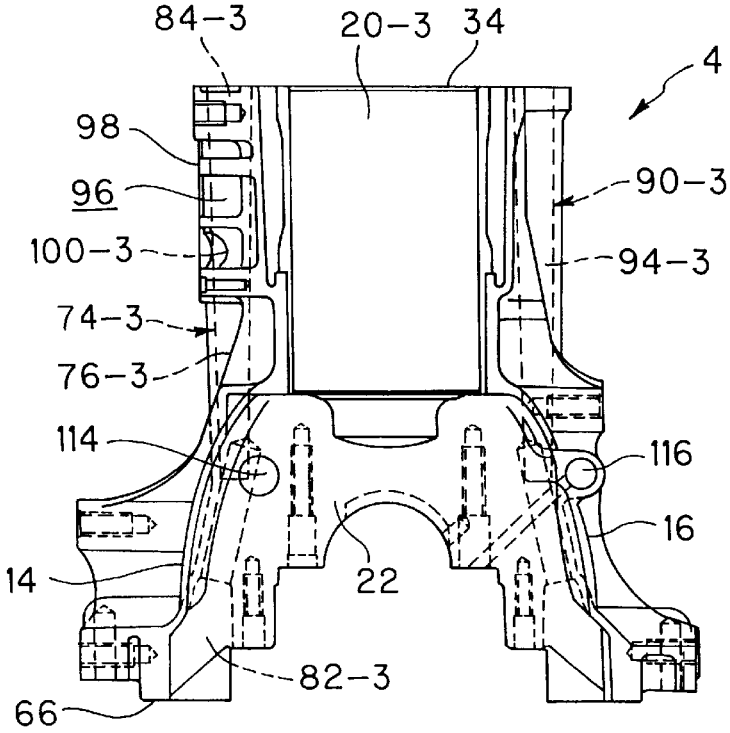
FIG. 3 is a sectional view taken along a line III—III of FIG. 1.
Figure 4:
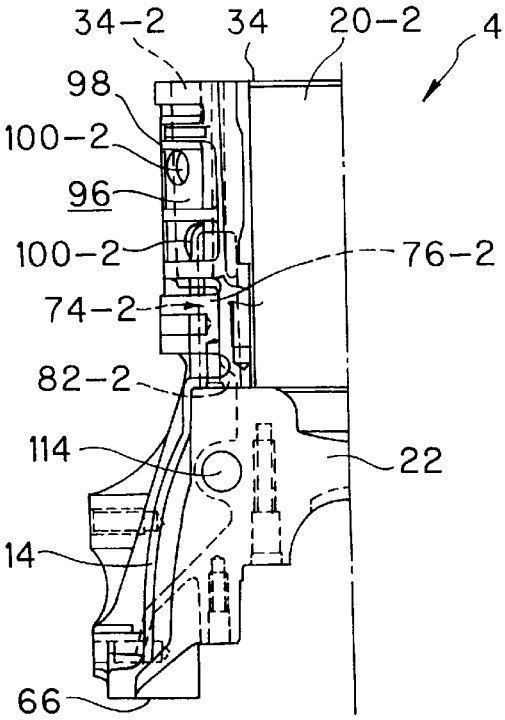
FIG. 4 is a half sectional view taken along a line IV—IV of FIG. 1.

As shown by FIGS. 1–3, the respective block side first and third blowby gas paths 76-1 and 76-3 are respectively disposed on the end side portions of the cylinder block 4 in the longitudinal direction and are installed such that a first and a third inlet 82-1 and 82-3 on the one end or side are respectively opened to the oil pan match face 66 on the upper side of the crank chamber 70. The blowby gas paths are installed such that a first and a third outlet 84-1 and 84-3 on the other end or side of the cylinder 20 are opened to the head match face 34.

The block side second blowby gas path 76-2 is disposed on the intermediary side portion of the cylinder block 4 in the longitudinal direction between the blowby gas paths 76-1 and 76-3. The block side second blowby gas path 76-2 is installed such that a second inlet 82-2 on the one end is branched into two paths that respectively open to part of the cylinder portion 12 on the upper side of the crank chamber 70. A middle portion of the second blowby gas path 76-2 is separated by a rib 86 and, while changing the path areas, the two branched portions gather together into a second outlet 84-2 to open to the head match face 34.

The one end of the head side blowby gas paths 78-1 through 78-3 communicates with the respective other ends of the block side blowby gas paths 76-1 through 76-3 at the head match face 34 and the block match face 36 as shown in FIG. 14. The other ends or sides of the blowby gas paths 78-1 through 78-3 communicate with the breather chamber 64 by a first through a third blowby gas path exemplified by element 88 in FIGS. 14–16.

Further, as shown in FIG. 7 through FIG. 14, the internal combustion engine 2 is installed with a plurality of oil dropping and blowby gas paths 90, with ends which are opened to the valve operating chamber 52 of the cylinder head 6. The oil dropping and blowby gas paths 90 pass through the cylinder head 6 and the cylinder 4 and the other ends or sides which open to the crank chamber 70. According to the embodiment, there are installed first through third oil dropping and blowby gas paths 90-1 through 90-3. In the following, an explanation will be given by describing the oil dropping and blowby gas paths 90-1 through 90-3 simply as first through third oil dropping paths.

The plurality of oil dropping paths 90-1 through 90-3 are installed at positions on the other side portion of the cylinder block 4 in the width direction (exhaust side installed with the exhaust ports 42) among the cylinders 20-1 through 20-4 in the internal combustion engine, as shown in FIG. 7. The plurality of cylinders 20-1 through 20-4 are aligned in series and aligned in the longitudinal direction independently from each other. Thus, as shown in FIG. 7, the oil dropping paths 90-1 are on the other side of the cylinders 20-1 to 20-4 from the block side gas paths 76-1 to 76-3.

Figure 11:
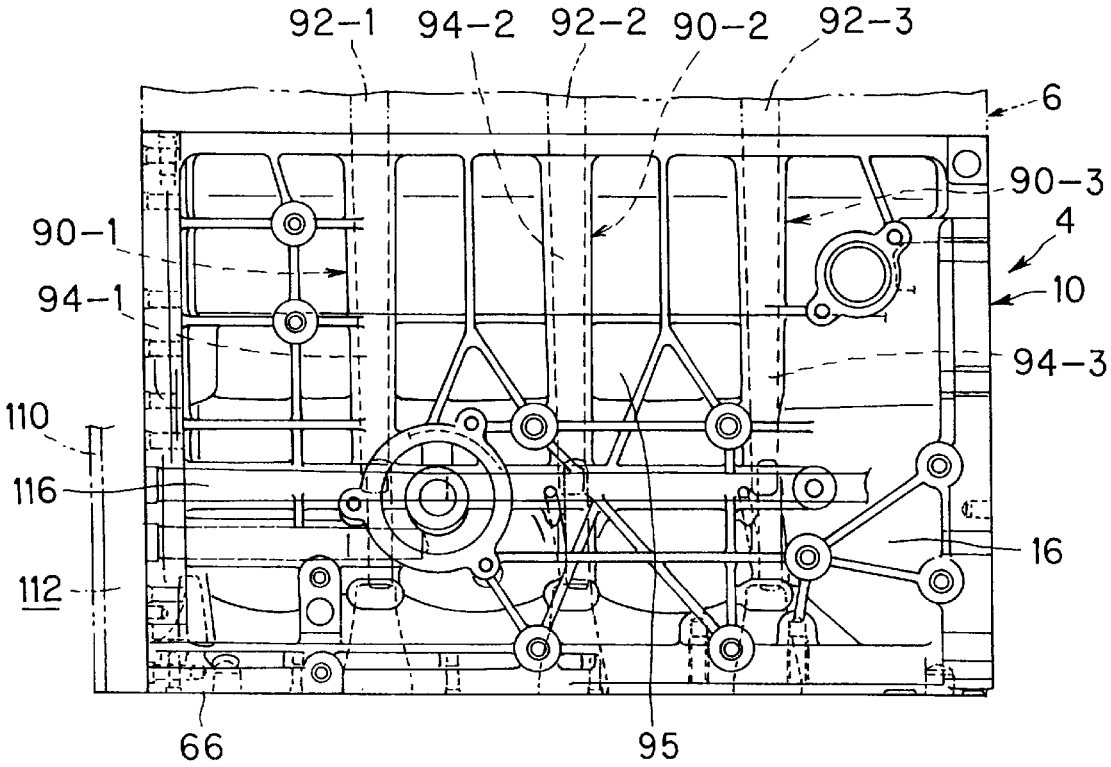
FIG. 11 is a back view of the cylinder block.
Figure 12:
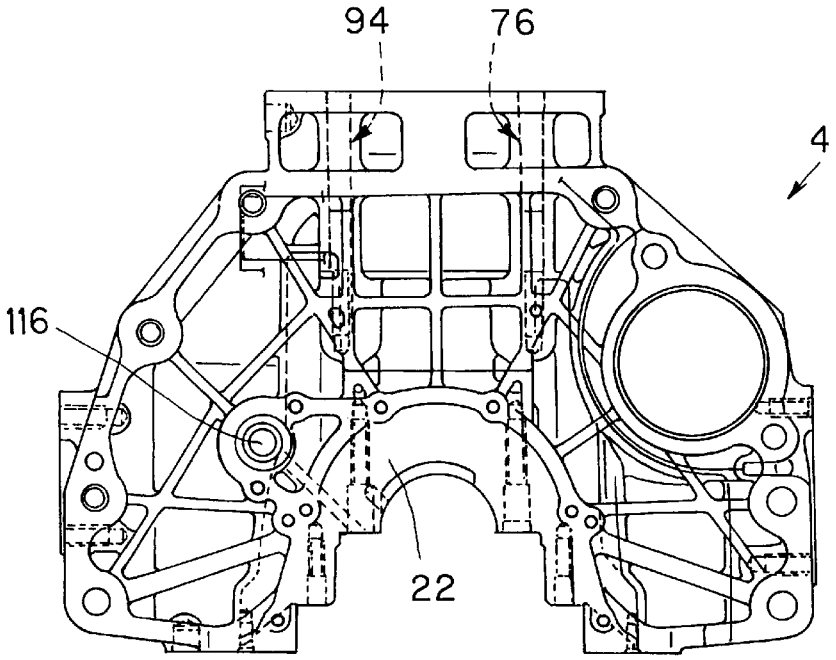
FIG. 12 is a side view viewed from an arrow mark VII of FIG. 1.

As shown in FIG. 11, the oil dropping paths 90-1 through 90-3 are constituted by head side first through third oil dropping paths 92-1 through 92-3 and block side first through third oil dropping paths 94-1 through 94-3 communicating with the head side oil dropping paths.

The oil dropping paths 90-1 through 90-3 project from an other side wall portion on the other side of the cylinders in the width direction from the block side blowby gas paths 76-1 through 76-3. The oil dropping paths 90-1 through 9-3 are respectively positioned between the first and the second cylinders 20-1 and 20-2, between the second and the third cylinders 20-2 and 20-3 and between the third and the fourth cylinders 20-3 and 20-4, respectively, and penetrate the respective crank shaft support portions 22.

As shown in FIG. 14, the plurality of oil dropping paths 90-1 through 90-3 are installed such that the one ends of the head side oil dropping paths 92-1 through 92-3 are opened to the valve operating chamber 52. The oil dropping paths 90-1 through 90-3 are installed such that the other ends respectively communicate with ends of the block side oil dropping paths 94-1 through 94-3 at the head match face 34 and the block match face 36. The other ends of the block side oil dropping paths 94-1 through 94-3 are respectively opened in the vicinity of the oil pan match face 66 on the upper side of the crank chamber 70.

The blowby gas path structure of the internal combustion engine 2 includes a communication chamber 96 for communicating the plurality of blowby gas paths 74-1 through 74-3. According to the embodiment, as shown by FIG. 1 through FIG. 6, on the one side in the width direction of the cylinder block 4, there is installed the communication chamber 96 for communicating among or between the respective block side blowby gas paths 76-1 through 76-3 aligned in the longitudinal direction independently from each other.

Figure 5:
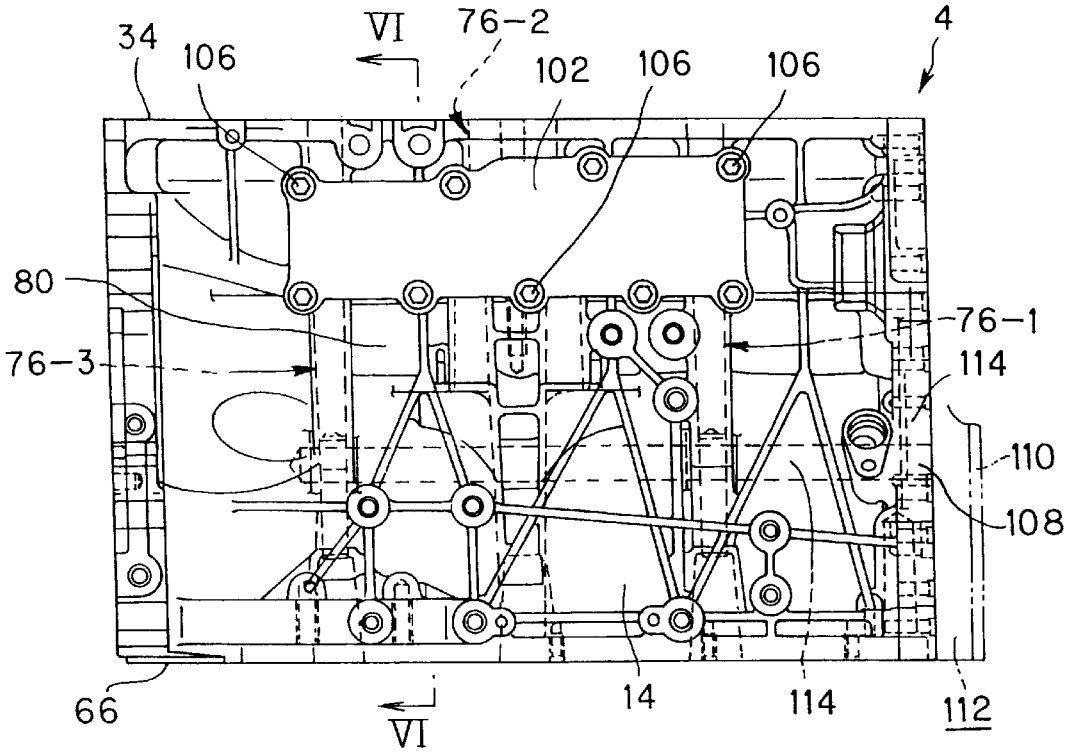
FIG. 5 is a side view of the cylinder block attached with a lid.
Figure 6:
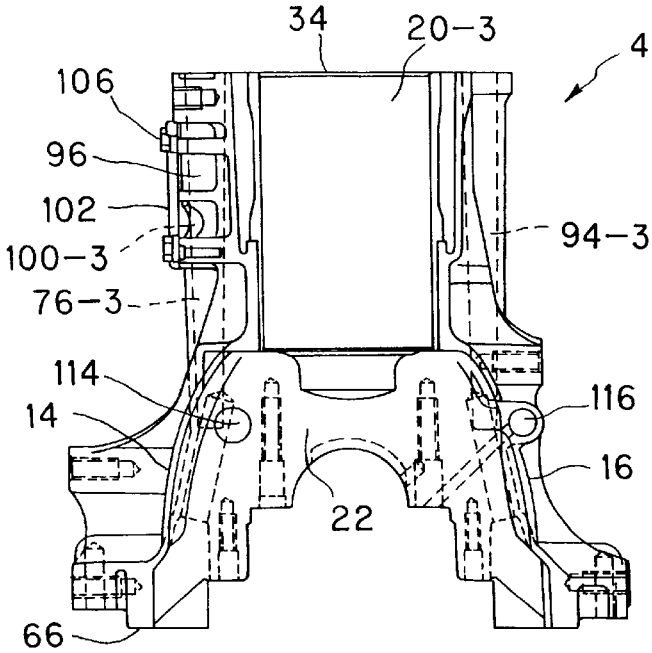
FIG. 6 is a sectional view taken along a line VI—VI of FIG. 5.

The cylinder block 4 includes a peripheral wall 98 projecting from the one side wall portion 80 on the one side in the width direction of the cylinder portion 12 and surrounding the block side blowby gas paths 76-1 through 76-3. The communication chamber 96 is formed by a partition in the peripheral wall portion 98. The one side wall portion 80 in the peripheral wall portion 98 includes first through third communication holes 100-1 to 100-3 for communicating the communication chamber 96 with the respective block side blowby gas paths 76-1 through 76-3. As shown by FIG. 5 and FIG. 6, the peripheral wall portion 98 is attached with a lid 102 to cover the communication chamber 96. The lid 102 is attached to the peripheral wall portion 98 by screwing attaching bolts 106 to attaching holes 104 of the peripheral wall portion 98.

Further, according to the blowby gas path structure, a communication path 114 communicates the respective block side blowby gas paths 76-1 and 76-3 disposed on the end side portions in the longitudinal direction of the cylinder block 4 and a chain chamber 112 of a chain cover 110 attached to one end wall 108 on the one end side in the longitudinal direction of the cylinder block 4. Further, in FIG. 2, notation 116 designates an oil path.

Next, an explanation will be given of the operation of the embodiment. In driving the internal combustion engine 2, negative pressure of intake air of, for example, an intake path on the downstream side of a throttle valve, not illustrated, constituting an intake system, operates on the breather chamber 64 via a PCV valve (not illustrated). The negative pressure of intake air operates on the crank chamber 70 via the plurality of first through third blowby gas paths 74-1 through 74-3.

Blowby gas passes through an intermediary between the piston 32 and the cylinder sleeve 18 and can leak to the crank chamber 70. The blowby gas passes through the block side blowby gas paths 76-1 through 76-3 and the head side blowby gas paths 78-1 through 78-3 constituting the blowby gas paths 74-1 through 74-3. The gas passes because of the negative pressure of intake air and is guided to the breather chamber 64, respectively, by the cover side blowby gas paths 88-1 through 88-3.

Blowby gas in the breather chamber 64 is separated of incorporated oil mist, sucked to the intake path on the downstream side of the throttle valve constituting the intake system via the PCV valve operated in accordance with the negative pressure of intake air and supplied to, and combusted in combustion chambers 38 from the intake ports 40, along with intake air.

Oil mist separated in the breather chamber 64 flows down to the valve operating chamber 52. Oil in the valve operating chamber 52 passes through the head side oil dropping paths 96-1 through 96-3 and the block side blowby gas paths 98-1 through 98-3, constituting the plurality of oil dropping paths 90-1 through 90-3, and is guided into the oil pan 10 by flowing down in the crank chamber 70.

New air from, for example, an air cleaner, not illustrated, of the intake system flows to the oil dropping paths 90-1 through 90-3 along with oil and is guided to the crank chamber 70. The new air replaces blowby gas guided to the breather chamber 64 by the blowby gas paths 74-1 through 74-3 and ventilates the crank chamber 70.

The internal combustion engine 2 is provided with the plurality of cylinders 20-1 through 20-4 aligned in series. The plurality of first through third blowby gas paths 74-1 through 74-3 are disposed and aligned on the one side (intake side installed with the intake port 40) in the width direction among the cylinders 20-1 through 20-4. The blowby gas paths 74-1 through 74-3 are installed to make the path sectional area of the second blowby gas path 74-2 disposed on the intermediary side portion in the longitudinal direction larger than the path sectional areas of the respective first and third blowby gas paths disposed on the opposing end side portions in the longitudinal direction of the cylinder block 4.

According to the internal combustion engine 2 having the plurality of cylinders 20-1 through 20-4 aligned in series, timings of vertical motion of pistons of the first and the fourth cylinders 20-1 and 20-4 are synchronized with each other and timings of vertical motion of pistons of the second and the third cylinders 20-2 and 20-3 are synchronized with each other.

Thereby, pressure variation of the second blowby gas path 74-2 disposed between the second and the third cylinders 20-2 and 20-3 is larger than pressure variation of the first blowby gas path 74-1 disposed between the first and the second cylinders 20-1 and 20-2 and the third blowby gas path 74-1 disposed between the third and the fourth cylinders 20-3 and 20-4.

Accordingly, the path sectional area of the first blowby gas path 74-1 disposed in the longitudinal direction between the second and the third cylinders 20-2 and 20-3 on the intermediary side portion, is made larger than the path sectional areas of the respective first and third blowby gas paths 74-1 and 74-3 disposed respectively between the first and the second cylinders 20-1 and 20-2 and between the third and the fourth cylinders 20-3 and 20-4 on the end side portions of the cylinder block 4. This causes a drawback because when the flow rate of the second blowby gas path 74-2 having the larger path sectional area becomes larger than the flow rate of the first and third blowby gas paths 74-1 and 74-3, more oil mist is conveyed to the breather chamber 64 and the oil separating function is deteriorated.

According to the blowby gas path structure of the internal combustion engine 2, the block side blowby gas paths 76-1 through 76-3 of the blowby gas paths 74-1 through 74-3 communicate with the communication chamber 96. As shown by FIG. 1 through FIG. 4, the communication chamber 96 is installed to partition at the position side wall portion 80 on the one side in the width direction of the cylinder block 4 by the peripheral wall portion 98 and the lid 102. The communication chamber 96 communicates respectively with the block side blowby gas paths 76-1 through 76-3 through the respective communication holes 100-1 through 100-3.

In this way, according to the blowby gas path structure of the internal combustion engine 2, by installing the communication chamber 96 for communicating the plurality of blowby gas paths 74-1 through 74-3 having the different path sectional areas, the flow speed of the second blowby gas path 74-2 having the flow rate larger than those of the first and the third blowby gas paths 74-1 and 74-3, can be reduced by the communication chamber 96 and oil mist can be made difficult to convey.

Therefore, according to the blowby gas path structure, oil mist conveyed by the second blowby gas path 74-2 having the large flow rate in the plurality of blowby gas paths 74-1 through 74-3, can be reduced and deterioration in the oil separating function of the breather chamber 64 in the head cover 8 can be prevented.

Further, the blowby gas path structure of the embodiment is installed such that one of the ends of the first and the third blowby gas paths 76-1 and 76-3, respectively disposed on the end side portions of the cylinder block 4 in the longitudinal direction, are opened in the vicinity of the oil pan match face 66 on the lower side of the crank chamber 70. The first and third blowby gas paths 76-1 and 76-3 are installed such that the other ends on the opposing side of the cylinder block are opened to the head match face 34, and positioned such that one end of the second blowby gas path 76-2 is disposed on the intermediary side portion of the cylinder block 4 between the first and third blowby gas paths. The second blowby gas path 76-2 is branched in two and the two branched portions are respectively opened near the cylinder portion 12 on the upper side of the crank chamber 70. Middle portions of the second blowby gas path 76-2 are separated by the rib 86 and while changing the path areas, the two branched portions are opened to the head match face 34 on the other end thereof.

Further, the blowby gas path structure of the embodiment is installed with the communication path 114 for communicating the respective block side first and third blowby gas paths 76-1 and 76-3 having ends or openings, respectively disposed on the end side portions of the cylinder block 4 in the longitudinal direction. The chain chamber 112 of the chain cover 110 is attached to the one end wall 108 on the one side portion of the cylinder block 4 in the longitudinal direction.

Thereby, according to the blowby gas path structure, the flow speed of the second blowby gas path 74-2 having the large path sectional area on the intermediary side portion can have a large flow rate compared with those of the first and second blowby gas paths 74-1 and 74-3 on the end side portions of the cylinder block 4. The flow rate of the second blowby gas path 74-2 can be reduced by the communication chamber 96. Oil mist can be made difficult to convey and further, the chain chamber 112 can be operated and ventilated by negative pressure of intake air via the communication path 114.

Figure 15:
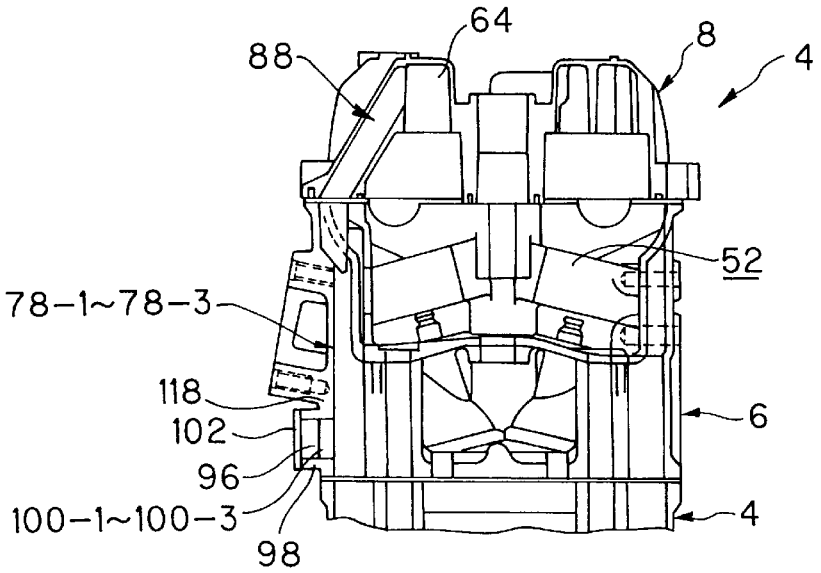
FIG. 15 is a sectional view of a cylinder head portion of an internal combustion engine showing other embodiment.
Figure 16:
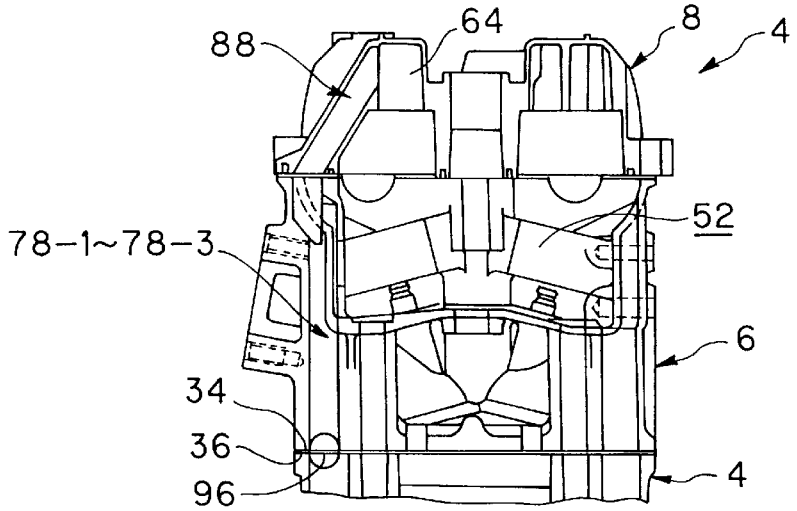
FIG. 16 is a sectional view of a cylinder head portion of an internal combustion engine showing still another embodiment.

Further, although the communication chamber 96 of the above-described embodiment is installed at the cylinder block 4, it can also be installed at other positions as shown by FIG. 15 and FIG. 16.

In FIG. 15, the communication chamber 96 respectively communicating the respective head side blowby gas paths 78-1 through 78-3 of the cylinder head 6 constituting the blowby gas paths 74-1 74-3, is installed at the cylinder head 6. The cylinder head 6 is installed such that the communication chamber 96 is partitioned by projecting the peripheral wall portion 98 from one side wall portion 118 on the one side in the width direction to surround the head side blowby gas paths 78-1 through 78-3. The communication holes 100-1 through 100-3 communicate the communication chamber 96 with the respective head side blowby gas paths 78-1 through 78-3 at the one side wall portion 118 in the peripheral wall portion 98. The lid 102 is attached to the peripheral wall portion 98 to cover the communication chamber 96.

Thereby, according to the blowby gas path structure, the second blowby gas path 70-2 having the larger flow rate than those of the first and the third blowby gas paths 74-1 and 74-3, has the flow rate reduced by the communication chamber 96 and oil mist can be made difficult to convey. Oil mist conveyed by the second blowby gas path 74-2 can be reduced and the deterioration of the oil separating function of the breather chamber 64 of the head cover 8 can be prevented.

In FIG. 16, the communication chamber 96 communicates the respective block side blowby gas paths 76-1 through 76-3 with the respective head side blowby gas paths 78-1 through 78-3, this constituting the blowby gas paths 74-1 through 74-3. The blowby gas paths 74-1 through 74-3 are aligned in the longitudinal direction independently from each other at the head match face 34 of the cylinder block 4 and the block match face 36 of the cylinder head 6. The communication chamber 96 is installed by recessing the head match face 34 and the block match face 36 respectively in the longitudinal direction.

In use, deterioration of the oil separating function of the breather chamber 64 of the head cover 8 can be prevented. Further, the internal combustion engine 2 can be made compact by installing the communication chamber 96 at the head match face 34 and the block match face 36 without projecting the communication chamber 96 to outside.

Figure 17:
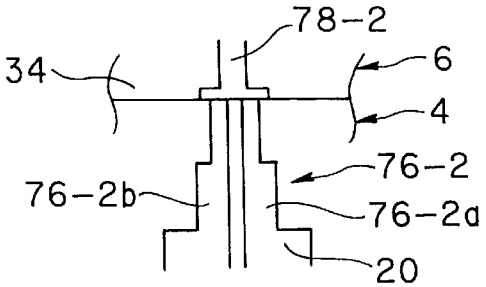
FIG. 17 is an outline view showing a modified example of a block side blowby gas path.

Further, although the block side second blowby gas path 76-2 in the above-described embodiment is installed such that the one end is branched and the other end is gathered with the branched portions, it can also be installed completely separately as shown by FIG. 17.

In FIG. 17, the block side second blowby gas path 76-2 disposed on the intermediary side portion between the blowby gas paths 76-1, 76-3 of the cylinder block 4 in the longitudinal direction separates into two separated second blowby gas paths 76-2*a* and 76-2*b* arranged proximate to each other. The ends of the two block side separated second blowby gas paths respectively open to the upper side of the crank chamber 70 and the other end opens to communicate with the head side second blowby gas path 78-2 at the head match face 34. Therefore, the block side second blowby gas path 76-2 disposed on the intermediary side portion of the cylinder block 4 in the longitudinal direction is divided into two block side separated second blowby gas paths 76-2*a* and 76-2*b*. Machining of the block side second blowby gas path 76-2 is facilitated and large pressure variations of the second and third cylinders 20-2 and 20-3 in which timings of vertical motion of pistons are synchronized with each other, can be dispersed.

In this way, according to the blowby gas path structure of the internal combustion engine, by installing the communication chamber for communicating the plurality of blowby gas paths having the different path sectional areas, the flow speed of the blowby gas path having the larger flow rate can be reduced and oil mist can be made difficult to convey. Therefore, according to the blowby gas path structure, oil mist conveyed by the blowby gas path having the large flow rate through the plurality of blowby gas paths can be reduced, and the deterioration of the oil separating function of the breather chamber of the head cover can be prevented.

What is claimed is:

1. A blowby gas path structure of an internal combustion engine comprising a plurality of blowby gas paths having different path sectional areas which pass through a cylinder block and a cylinder head, one end of the blowby gas paths opening to a crank chamber of the internal combustion engine, and other opposing ends of the blowby gas paths opening to a breather chamber of a head cover, and a communication chamber for communicating the plurality of blowby gas paths.

2. The blowby gas path structure of an internal combustion engine according to claim 1, wherein the plurality of blowby gas paths are disposed on one side in a width direction among a plurality of cylinders of the internal combustion engine, the plurality of cylinders aligned in series and aligned in a longitudinal direction independently from each other and path sectional areas of the blowby gas paths disposed in the longitudinal direction on an intermediary side portion of the one side of the cylinder block are larger than path sectional areas of the respective blowby gas paths respectively disposed in the longitudinal direction on end side portions of the one side of the cylinder block.

3. The blowby gas path structure of an internal combustion engine according to claim 1, wherein the plurality of blowby gas paths comprise block side blowby gas paths of the cylinder block and head side blowby gas paths of the cylinder head communicating with the block side blowby gas paths, one end of the respective block side blowby gas paths respectively disposed in a longitudinal direction on end side portions of the cylinder block to open at a lower side to a crank chamber and other ends of the respective block side blowby gas paths opened to a head match face, the one end of the block side blowby gas paths are disposed in the longitudinal direction on an intermediary side portion of the cylinder block to branch and to respectively open at an upper side of the crank chamber and the other ends thereof gather together to open at the head match face.

4. The blowby gas path structure of an internal combustion engine according to claim 3, wherein the cylinder block includes the communication chamber for communicating among the respective block side blowby gas paths aligned independently from each other in the longitudinal direction.

5. The blowby gas path structure of an internal combustion engine according to claim 3, wherein the cylinder block includes a communication path for communicating the respective block side blowby gas paths respectively disposed on the end side portions of the cylinder block in the longitudinal direction and a chain chamber of a chain cover.

6. The blowby gas path structure of an internal combustion engine according to claim 3, wherein the cylinder head includes the communication chamber respectively communicating the respective head side blowby gas paths aligned independently from each other in the longitudinal direction.

7. The blowby gas path structure of an internal combustion engine according to claim 3, wherein the head match face of the cylinder block and a block match face of the cylinder head include the communication chamber for respectively communicating the respective block side blowby gas paths and the respective head side blowby gas paths aligned independently from each other in the longitudinal direction.

8. The blowby gas path structure of an internal combustion engine according to claim 3, wherein the cylinder block includes the block side blowby gas paths disposed in the longitudinal direction on the intermediary side portion and separating into two of the block side separated blowby gas paths arranged proximate to each other, the one ends of the two of the block side separated blowby gas paths respectively opening to the upper side of the crank chamber and the other end sides respectively opening to the head match face to communicate with the head side blowby gas paths.

9. A blowby gas path structure in an internal combustion engine comprising:

a cylinder block;

a cylinder head;

the blowby gas path structure including a plurality of blowby gas paths passing through said cylinder block and said cylinder head, said plurality of blowby gas paths having openings at opposing ends thereof, at least one of the blowby gas paths having a different path sectional area;

a crank chamber of the engine receiving ends of the blowby gas paths;

a breather chamber of a head cover of the engine receiving other opposing ends of the blowby gas paths; and a communication chamber for communicating between the plurality of blowby gas paths.

10. The blowby gas path structure of claim 9, wherein the communication chamber is included in said cylinder head.

11. The blowby gas path structure of claim 9, wherein a respective block match face of said cylinder block and a head match face of said cylinder head join said cylinder block and cylinder head while maintaining alignment of the plurality of blowby gas paths therethrough.

12. The blowby gas path structure of claim 11, wherein the communication chamber is formed at the respective match faces of said cylinder block and said cylinder head.

13. The blowby gas path structure of claim 9, wherein said cylinder block includes the communication chamber.

* * * * *